US006715724B2

(12) United States Patent
Wells et al.

(10) Patent No.: US 6,715,724 B2
(45) Date of Patent: Apr. 6, 2004

(54) ADJUSTABLE SUPPORT FOR A FIREPLACE

(75) Inventors: Jack Jason Wells, Rice, WA (US); Matthew Carter Wicks, Colville, WA (US); Daniel Lee Holt, Kettle Falls, WA (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 10/119,542

(22) Filed: Apr. 9, 2002

(65) Prior Publication Data

US 2003/0189142 A1 Oct. 9, 2003

(51) Int. Cl.[7] ..... E04H 12/18

(52) U.S. Cl. ..... 248/188.6; 248/431; 126/500; 182/222

(58) Field of Search ..... 52/36.3, 71, 109, 52/645, 646; 248/188.2, 188.6, 346.07, 346.3, 431; 126/500, 544, 201, 277, 304 R, 304 A, 305; 182/141, 149, 157, 222

(56) References Cited

U.S. PATENT DOCUMENTS 2,806,747 A * 9/1957 Jaeger ..... 254/122
3,447,530 A * 6/1969 Santeramo ..... 126/9 R
3,823,915 A * 7/1974 Koehler ..... 254/122
3,880,139 A * 4/1975 Young ..... 126/9 R
4,492,215 A * 1/1985 DiGianvittorio ..... 126/9 R
4,584,986 A 4/1986 Cannata
5,119,603 A 6/1992 Jones
5,303,692 A 4/1994 Shasad
5,718,272 A 2/1998 Brazell
6,178,965 B1 * 1/2001 Sulak ..... 126/519
6,267,113 B1 * 7/2001 Maust ..... 126/512

* cited by examiner

*Primary Examiner*—Carl D. Friedman
*Assistant Examiner*—Naoko Slack
(74) *Attorney, Agent, or Firm*—Merchant & Gould P.C.

(57) ABSTRACT

An adjustable support structure for a fireplace including upper and lower bars extending in a longitudinal direction, the upper bar being positioned above the lower bar and including a surface upon which the fireplace can rest. First and second cross bars are also included, each with upper and lower ends, the upper end of the first cross bar being coupled to the upper bar and the lower end of the second cross bar being coupled to the lower bar. The lower end of the first cross bar is moveably coupled to the lower bar and the upper end of the second cross bar is moveably coupled to the upper bar such that the upper bar may be adjusted upwards in a plane with respect to the lower bar to a desired height.

13 Claims, 11 Drawing Sheets

ADJUSTABLE SUPPORT FOR A FIREPLACE

TECHNICAL FIELD

The present invention relates to fireplaces. More particularly, the invention relates to an adjustable support for a fireplace.

BACKGROUND

Fireplaces have become increasingly commonplace in homes, businesses, and other buildings. A fireplace may provide many benefits, including the creation of heat and an aesthetically-pleasing arrangement of flames and sounds. A variety of different types of fireplaces are available, including solid-fuel, gas, and electric. Each type of fireplace is typically mounted in an enclosure defined by a wall of a structure.

When installing a fireplace, additional support for the fireplace may be needed. For example, when a fireplace is installed into an existing enclosure in a wall of a structure, the enclosure may be too small to accommodate the entire fireplace, and a front of the fireplace may therefore extend beyond the enclosure and need additional support. Further, some fireplaces may be designed to extend out of the wall. In addition, it is sometimes desirable to install a fireplace at a given height, and support may be needed to maintain the fireplace at the desired height.

The height at which support for a fireplace may be needed can vary from installation to installation. Current support systems for fireplaces are not easily configurable and must typically be custom-made for a particular installation.

Therefore, it would be desirable to create an adjustable support structure for a fireplace.

SUMMARY

Generally, the present invention relates to fireplaces. More particularly, the invention relates to an adjustable support for a fireplace.

In one respect, the invention relates to an adjustable support structure for a fireplace including upper and lower bars extending in a longitudinal direction, the upper bar being positioned above the lower bar in a plane and the upper bar defining a surface upon which the fireplace can rest, and first and second cross bars, each with upper and lower ends, the upper end of the first cross bar being coupled to the upper bar and the lower end of the second cross bar being coupled to the lower bar, and wherein the lower end of the first cross bar is moveably coupled to the lower bar and the upper end of the second cross bar is moveably coupled to the upper bar such that the upper bar may be adjusted upwards in the plane with respect to the lower bar to a desired height.

In another aspect, the invention relates to an adjustable support structure for a fireplace including upper and lower bars, each extending in a longitudinal direction and each defining at least one aperture, the upper bar being positioned above the lower bar in a plane, and a scissor assembly including first and second cross bars, each with upper and lower ends and coupled to one another at about a midpoint of the first and second cross bars, the upper end of the first cross bar being coupled to a second end of the upper bar and the lower end of the second cross bar being coupled to a second end of the lower bar, and wherein the lower end of the first cross bar is moveable in the longitudinal direction towards the lower end of the second cross bar and the upper end of the second cross bar is moveable in the longitudinal direction towards the upper end of the first cross bar such that the upper bar is adjusted upwards in the plane with respect to the lower bar to a desired height and the lower end of the first cross bar may then be coupled to the at least one aperture of the lower bar and the upper end of the second cross bar may be coupled to the at least one aperture of the upper bar.

In yet another aspect, the invention relates to a method for adjusting a support structure for a fireplace including steps of: providing the support structure including upper and lower bars, a scissor assembly, and a surface for supporting the fireplace; adjusting the adjustable support to a desired height; and coupling the scissor assembly to the bars to lock the adjustable support at the desired height.

In another aspect, the invention relates to a method for supporting a fireplace including steps of: providing an adjustable support structure; adjusting the adjustable support structure to a desired height; and placing the adjustable support structure below the fireplace to support the fireplace.

In another aspect, the invention relates to an adjustable support structure for a fireplace including upper and lower bars extending in a longitudinal direction, the upper bar being positioned above the lower bar and the upper bar defining a surface upon which the fireplace can rest, first and second cross bars, each with upper and lower ends, and means for adjustably coupling the first and second cross bars to the upper and lower bars when the adjustable support structure is at a desired height.

The above summary of the present invention is not intended to describe each disclosed embodiment or every implementation of the present invention. Figures in the detailed description that follow more particularly exemplify embodiments of the invention. While certain embodiments will be illustrated and described, the invention is not limited to such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The invention relates to fireplaces. More particularly, the invention relates to an adjustable support for a fireplace. While the present invention is not so limited, an appreciation of the various aspects of the invention will be gained through a discussion of the examples provided below.

Example adjustable support structures made in accordance with this invention may generally include a scissor assembly having a set of bars coupled to a set of cross bars. In addition, a second set of bars and cross bars may be coupled to the first set of bars at an angle. A second scissor assembly may also be provided. Trim may be coupled to the scissor assemblies. Various embodiments of the present invention are described below.

I. Support Structure Components

Figure 1:
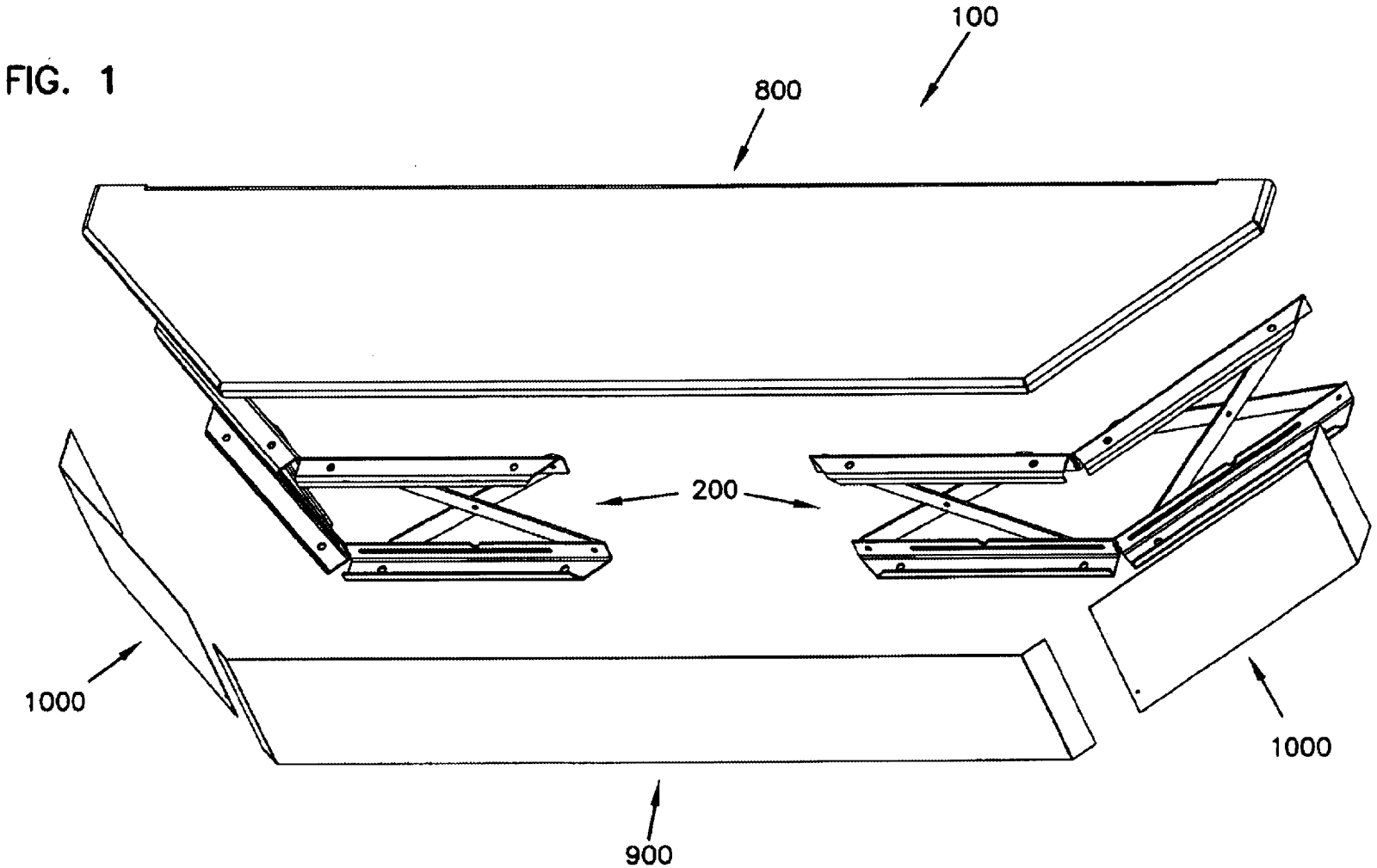
FIG. 1 is a schematic perspective view of an example embodiment of an adjustable support structure shown in exploded form and made in accordance with the present invention.

Referring now to FIG. 1, a first embodiment of an example adjustable support structure 100 for a fireplace is shown in exploded form. The adjustable support structure 100 generally includes two scissor assemblies 200 and top, front, and side trims 800, 900, and 1000. The adjustable support structure 100 may be adjusted in height depending on the requirements for support of a fireplace. For example, in one embodiment, the adjustable support structure 100 can be adjusted from 2 inches to 10 inches in height. However, any desired range of height can be used without departing from the spirit of the invention.

Figure 2:
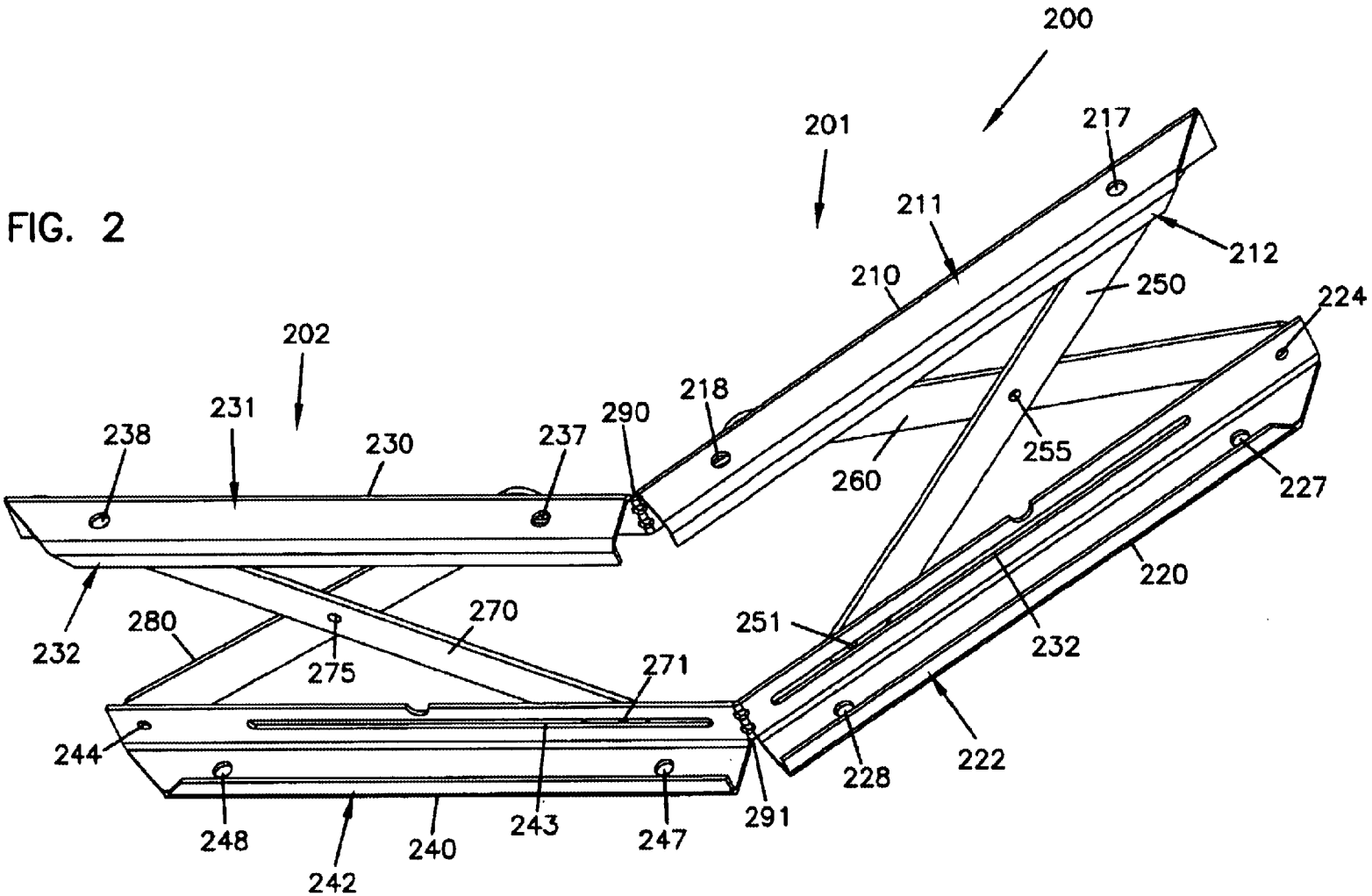
FIG. 2 is a schematic perspective view of an example embodiment of a scissor assembly made in accordance with the present invention.
Figure 3:
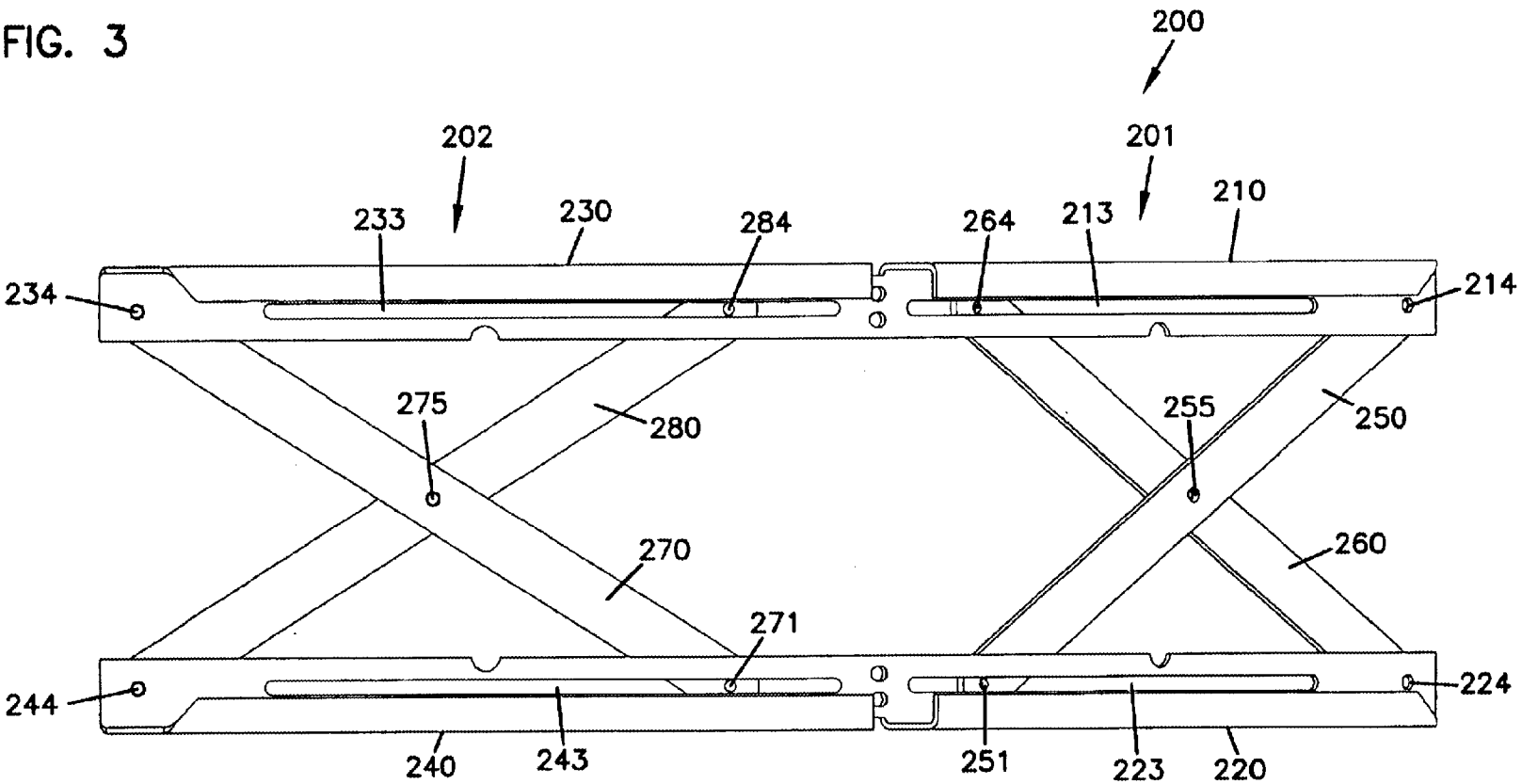
FIG. 3 is a schematic view of the example scissor assembly shown in FIG. 2.
Figure 4:
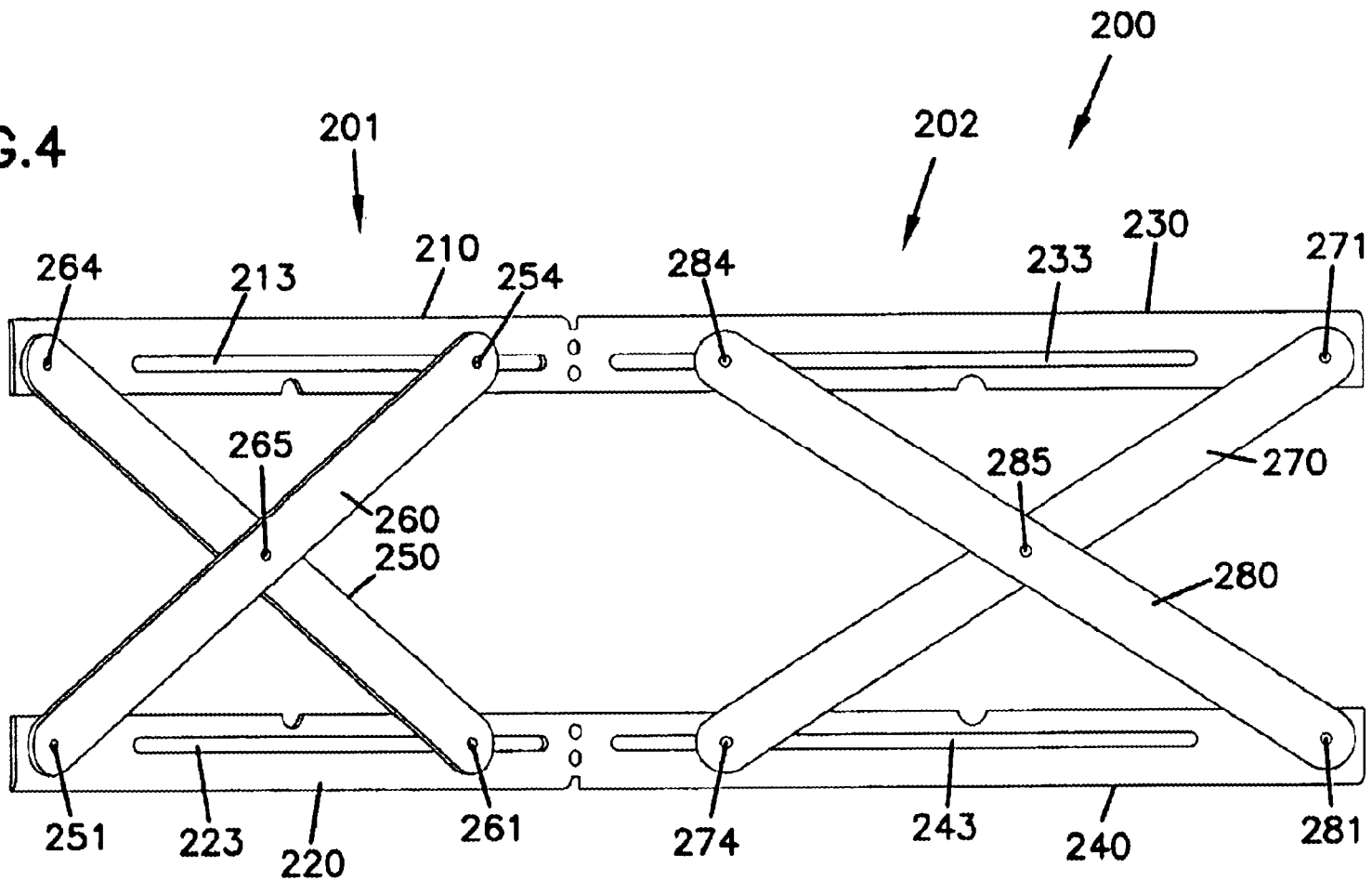
FIG. 4 is a schematic opposite view of the example scissor assembly shown in FIG. 3.

Referring now to FIGS. 2–4, one scissor assembly 200 is shown. The assembly 200 consists of two sub-assemblies 201 and 202 with bars 210 and 220, and 230 and 240, respectively. As shown, the bars 210 and 220 of the first sub-assembly 201 extend in a first longitudinal direction and bar 210 is positioned above bar 220. Bars 230 and 240 of the second sub-assembly 202 both extend in a second longitudinal direction at an angle with respect to the first longitudinal direction, and bar 230 is positioned above bar 240.

Bar 210 is coupled to bar 230 at a joint 290, and bar 220 is coupled to bar 240 at a joint 292, thereby coupling the first sub-assembly 201 to the second subassembly 202. The joints 290 and 291 may be fixed joints or hinged joints arranged to allow the first sub-assembly 201 to pivot with respect to the second sub-assembly 202. In the example embodiment shown, the joints 290 and 291 are fixed joints and may be formed by bending a single longitudinal bar to form the bars 210 and 230, and 220 and 240. It may be advantageous to configure the scissor assembly 200 to include bars extending at two angles so that the scissor assembly 200 may be self-supporting or freestanding (i.e. may stand on its own).

Upper surfaces 211 and 231 of bars 210 and 230 are configured to provide a surface upon which the upper trim 800 may be coupled and a portion of a fireplace can rest. Flanges 212, 222, 232, and 242 provide surfaces to which the front and side trims 900 and 1000 can be coupled.

The first sub-assembly 201 of the scissor assembly 200 also includes cross bars 250 and 260 positioned in a scissor arrangement. Likewise, the second subassembly 202 includes cross bars 270 and 280 positioned in the scissor arrangement. Each cross bar 250, 260, 270, and 280 defines an aperture 255, 265, 275, and 285, respectively, at about a midpoint. In one embodiment, the cross bars 270 and 280 are coupled so that each bar 270 and 280 can pivot about its midpoint.

Figure 5:
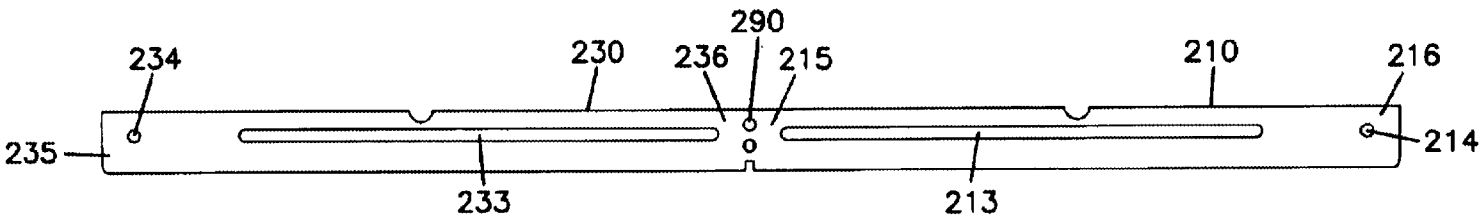
FIG. 5 is a schematic side view of an example embodiment of a bar shown in isolation.
Figure 6:
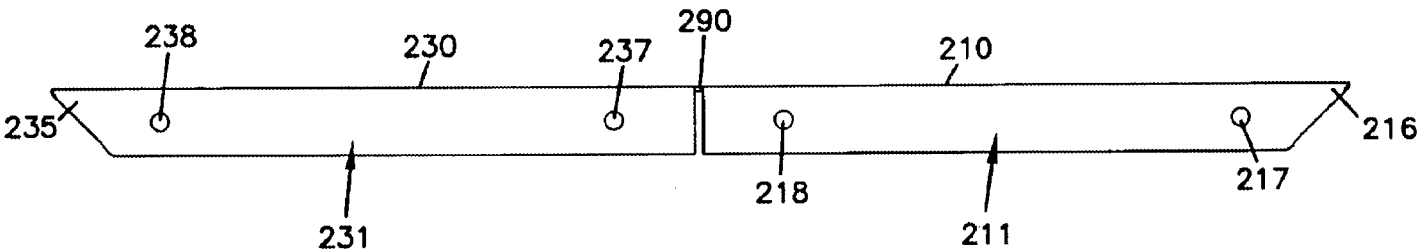
FIG. 6 is a schematic top view of the example bar shown in FIG. 5.
Figure 7:
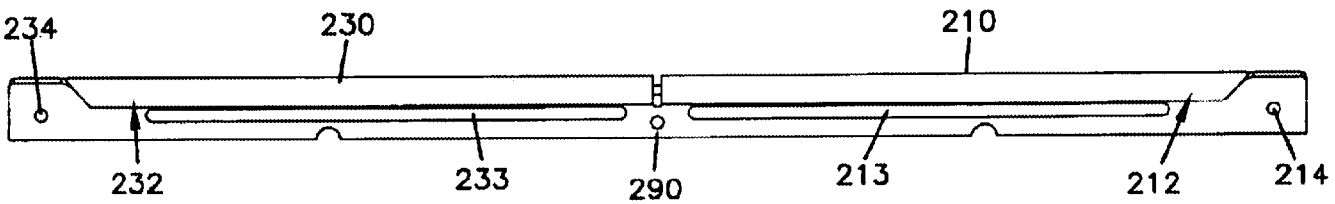
FIG. 7 is a schematic opposite side view of the example bar shown in FIG. 5.

Referring now to FIGS. 5–7, bars 210 and 230 are shown in isolation. Each bar 210 and 230 defines an aperture 213 and 233 running in the first and second longitudinal directions, respectively. In the example embodiment shown, the apertures 213 and 233 are slots. In addition, each bar 210 and 230 defines an aperture 214 and 234 at ends 216 and 235. Slots 223 and 243 and apertures 224 and 244 are similarly defined by bars 220 and 240. The slots and apertures are sized to receive screws, as described below. Apertures 217, 218, 227, 228, 237, 238, 247, and 248 may optionally be defined by the bars 210, 220, 230, and 240 to facilitate attachment of the trim using, for example, screws or welding.

Figure 8:
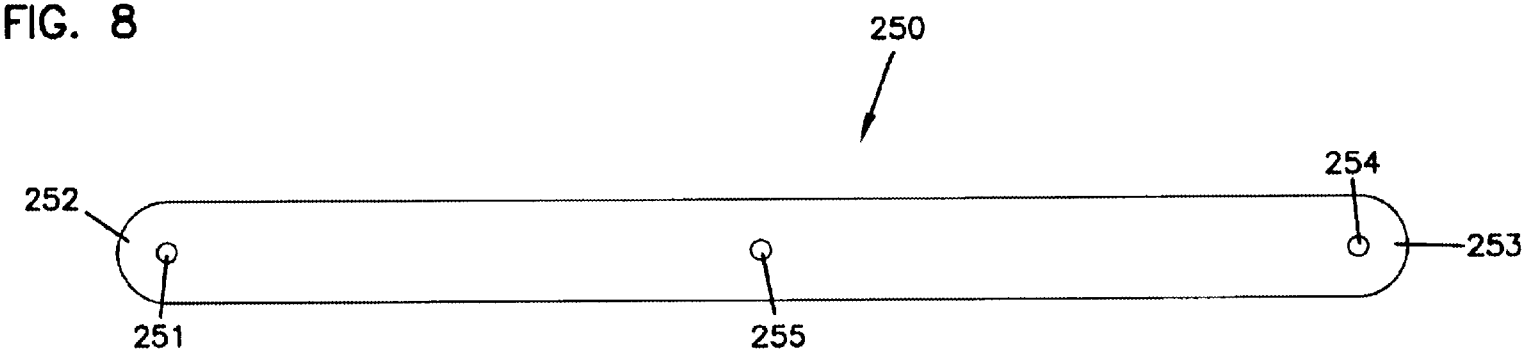
FIG. 8 is a schematic view of an example embodiment of a cross bar shown in isolation.

Referring now to FIG. 8, cross bar 250 is shown in isolation. In addition to the aperture 255, cross bar 250 defines apertures 251 and 254 at ends 252 and 253. Cross bars 260, 270, and 280 are configured in a like manner.

Figure 9:
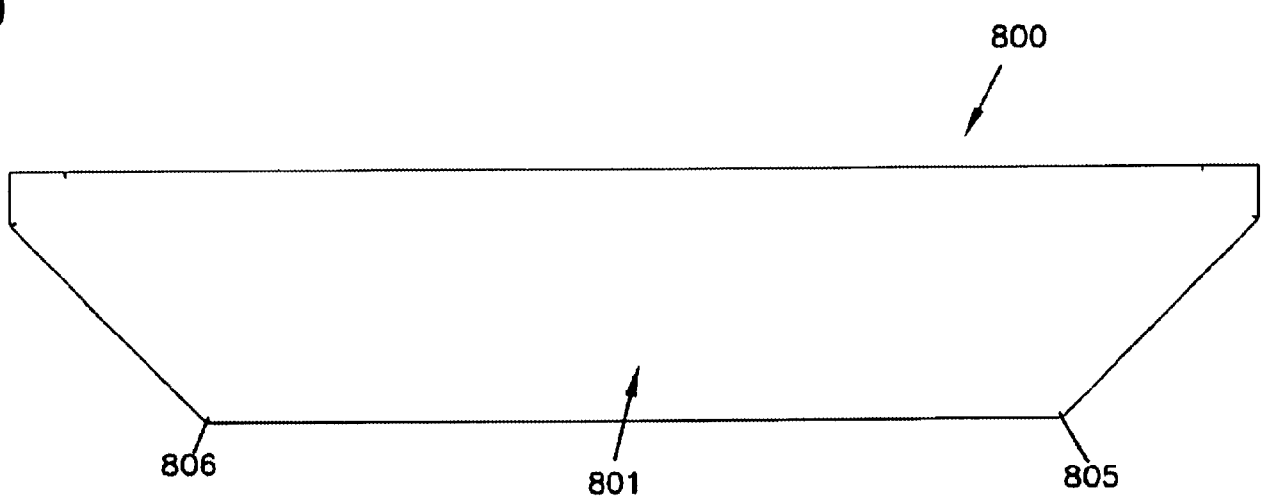
FIG. 9 is a schematic view of an example embodiment of a top trim shown in isolation.
Figure 10:
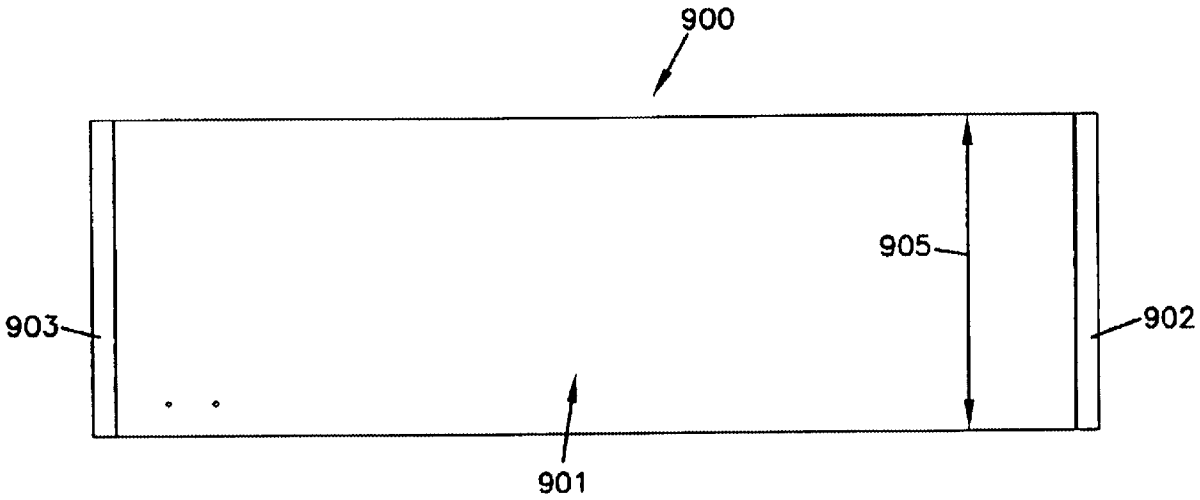
FIG. 10 is a schematic view of an example embodiment of a front trim shown in isolation.
Figure 11:
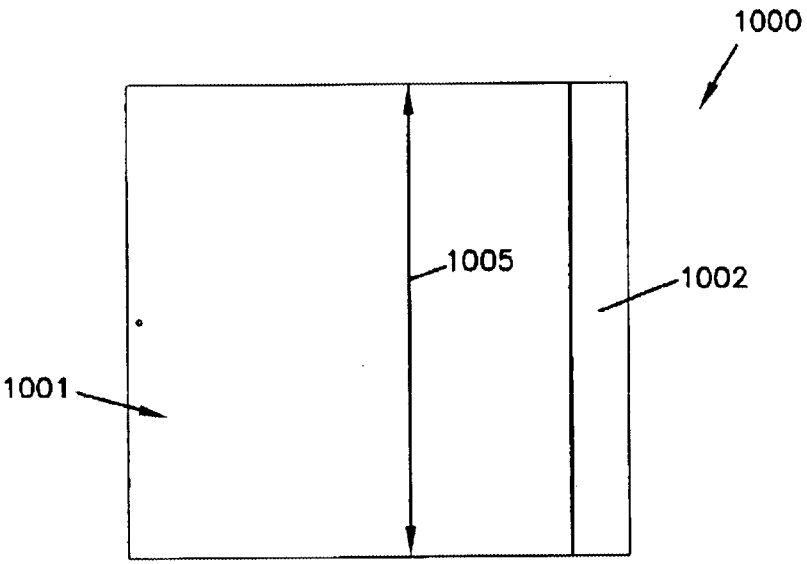
FIG. 11 is a schematic view of an example embodiment of a side trim shown in isolation.

Referring now to FIGS. 9–11, the top, front, and side trims 800, 900, and 1000 are shown. In FIG. 9, the top trim 800 is shown with a surface 801 upon which a portion of a fireplace may be rested. The top trim 800 is also angled at corners 805 and 806 to match the first and second longitudinal directions in which the first and second sub-assemblies 201 and 202 extend. In FIG. 10, the front trim 900 is shown with a front surface 901 and angled portions 902 and 903 angled to extend in the first longitudinal direction in which the first sub-assembly 201 extends. In FIG. 11, one of the two side trims 1000 is shown with a front surface 1001 and an angled portion 1002 angled to extend in the first longitudinal direction in which the first sub-assembly 201 extends. The trims 800, 900, and 1000 are all configurable in size to hide the scissor assemblies 200 when the adjustable support is fully assembled, as is shown, for example, in FIGS. 12 and 13.

II. Support Structure Assembly

The adjustable support structure 100 can be assembled as follows. Each scissor assembly 200 can be assembled by first determining the desired height for the adjustable support structure 100. The height of the adjustable support structure 100 can be adjusted by moving the apertures 251, 261, 271, and 281 formed in the cross bars 250, 260, 270, and 280 to a desired position along the slots 213, 223, 233, and 243 formed in the bars 210, 220, 230, and 240. The closer the apertures 251, 261, 271, and 281 are moved towards a midpoint of each bar 210, 220, 230, and 240, the greater the distance is created between bars 210 and 220, and 230 and 240, respectively, and the higher the bars 210 and 230 of the adjustable scissor assembly 200 are moved.

When the desired height is reached, the cross bars are coupled to the bars using, for example, screws. For example, for the first sub-assembly 201, screws may be placed through apertures 254 and 214, and 251 and slot 223, to couple the cross bar 250 to the bars 210 and 220. The head of each screw is typically larger than the width of the apertures and slots. In addition, screws may be placed through apertures 264 and 224, and 261 and slot 213, to couple the cross bar 260 to the bars 210 and 220. In addition, a screw may be placed through apertures 255 and 265 to coupled cross bars 250 and 260 to one another at about the midpoint. The second sub-assembly 202 is assembled in a similar manner.

If the desired height for the scissor assemblies 200 has not been attained, the screws may be removed and the height of the scissor assembly 200 readjusted.

Figure 12:
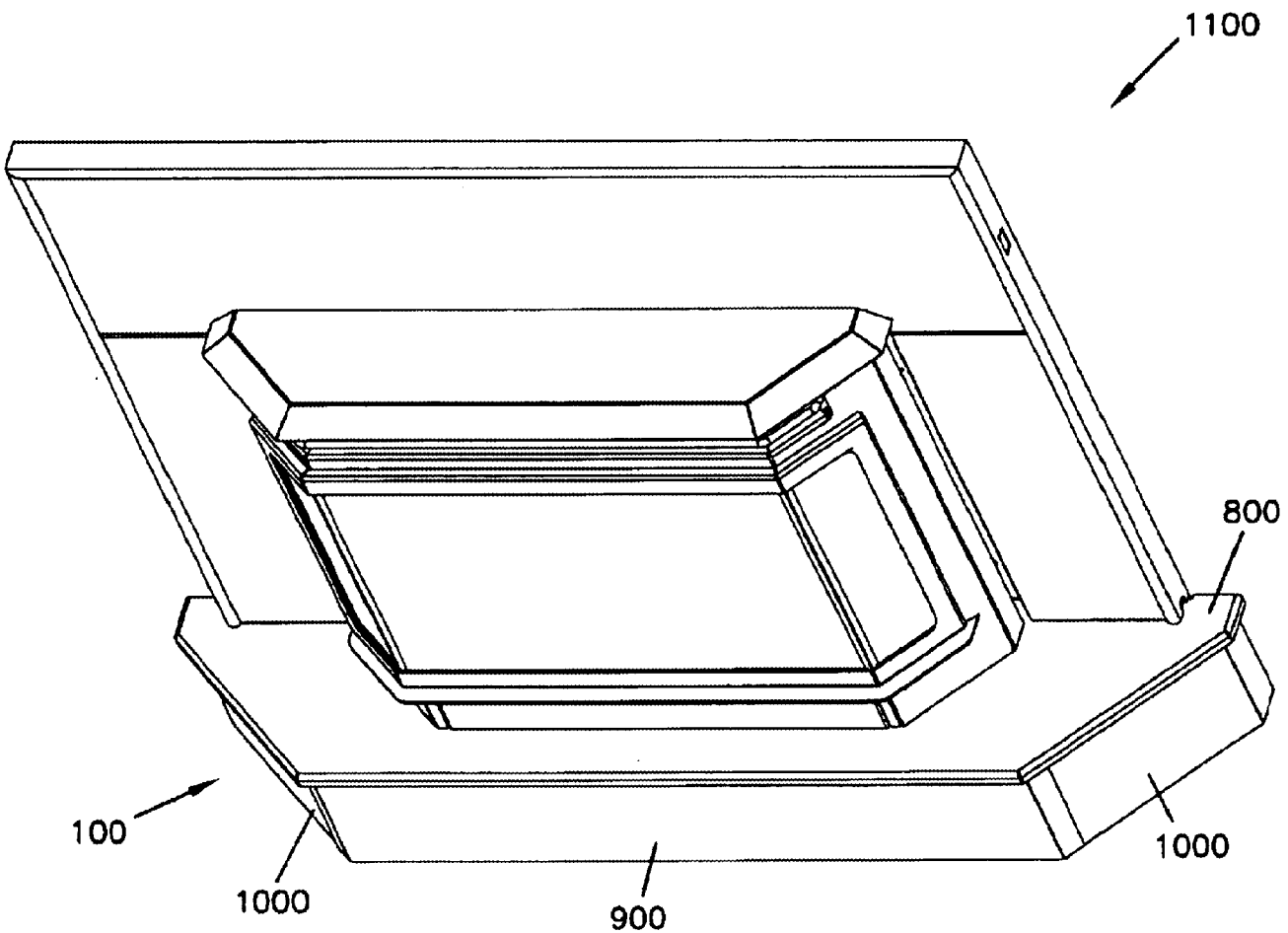
FIG. 12 is a schematic perspective view of an example embodiment of a fireplace and an example embodiment of an adjustable support structure in fully-assembled form.
Figure 13:
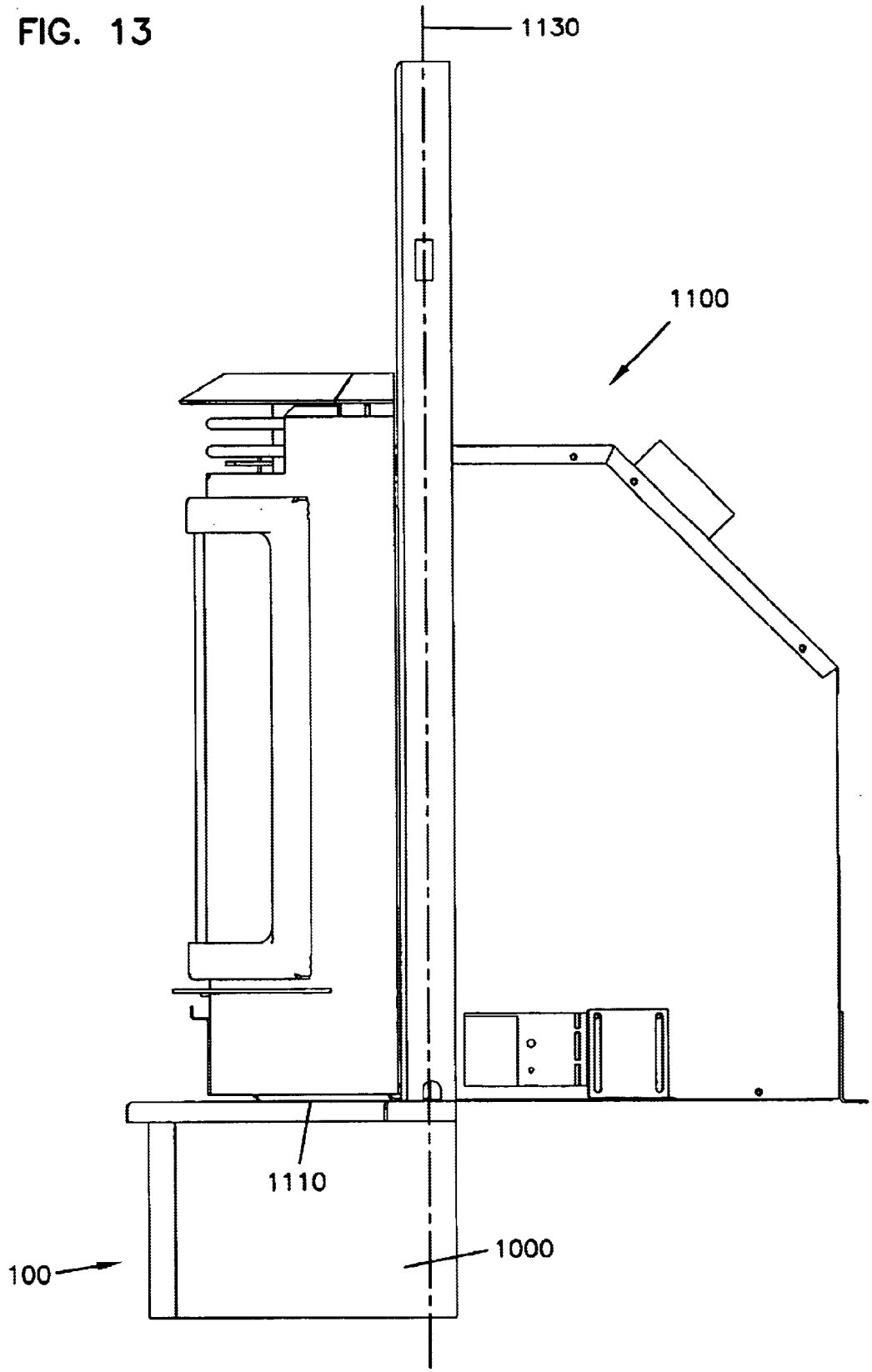
FIG. 13 is a schematic side view of the example fireplace and adjustable support structure shown in FIG. 12.

Once the scissor assemblies 200 have been assembled, the top, front, and side trims 800, 900, and 1000 can be added, as is shown in the exploded view of FIG. 1 and the fully-assembled views of FIGS. 12 and 13. The front and side trims 900 and 1000 may need to be sized depending on the height of the scissor assemblies 200. For example, the front and side trims 900 and 1000 may be cut in the first and second longitudinal directions, as needed, to size a height 905 and 1005 of the front and side trims 900 and 1000 so that they fit onto the scissor assemblies 200. Alternatively, front and side trims of different heights may be included, thereby eliminating the need for cutting.

Once the trim has been sized, each side trim 1000 can be coupled to surfaces 232 and 242 of the scissor assemblies 200 using, for example, additional screws. The front trim 900 can also be coupled to surfaces 212 and 222 of the scissor assemblies 200. The top trim 800 can be coupled to surfaces 211 and 231 of the scissor assemblies 200. In this configuration, the trims 800, 900, and 1000 can conceal the scissor assemblies 200 from view.

Referring now to FIGS. 12 and 13, the fully-assembled adjustable support structure 100 is shown partially supporting an example fireplace 1100. As shown, a portion 1105 of the fireplace 1100 extends beyond a wall 1130 within which the fireplace 1100 is disposed. The fireplace 1100 may be positioned to extend beyond the wall 1130 in this manner because, for example, the fireplace 1100 may be larger than the enclosure defined by the wall 1130 of the structure within which the fireplace 1100 is being installed. Alternatively, it may be necessary to raise the fireplace 1100 to a desired level.

A lower portion 1110 of the fireplace 1100 is supported by the adjustable support structure 100. Optionally, the adjustable support structure 100 may be connected to the fireplace 100 with screws or other attachment means following positioning under the fireplace 100.

As described above, the adjustable support structure 100 can be adjusted, as desired, to support the lower portion 1110 of the fireplace 1100 at a variety of desired heights. The adjustable support structure 100 may be adjusted to the desired height prior to placement below the fireplace 1100. Alternatively, the adjustable support structure 100 can be placed below the fireplace 1100 and then adjusted to the desired height.

The various components of the adjustable support structure 100 may be made of a variety of materials. In one example embodiment, the scissor assemblies 200 are made of a metal, for example, steel, of sufficient strength to hold a portion of a fireplace. In the example embodiment, the trim 800, 900, and 1000 is made of a sheet metal with surfaces 801, 901, and 1001 having a polished finish of a desired color such as, for example, gold, silver, or bronze. Alternatively, the surfaces may be the same color as the rest of the support structure or may be painted or otherwise colored to any desired color.

III. Alternative Embodiments

Figure 14:
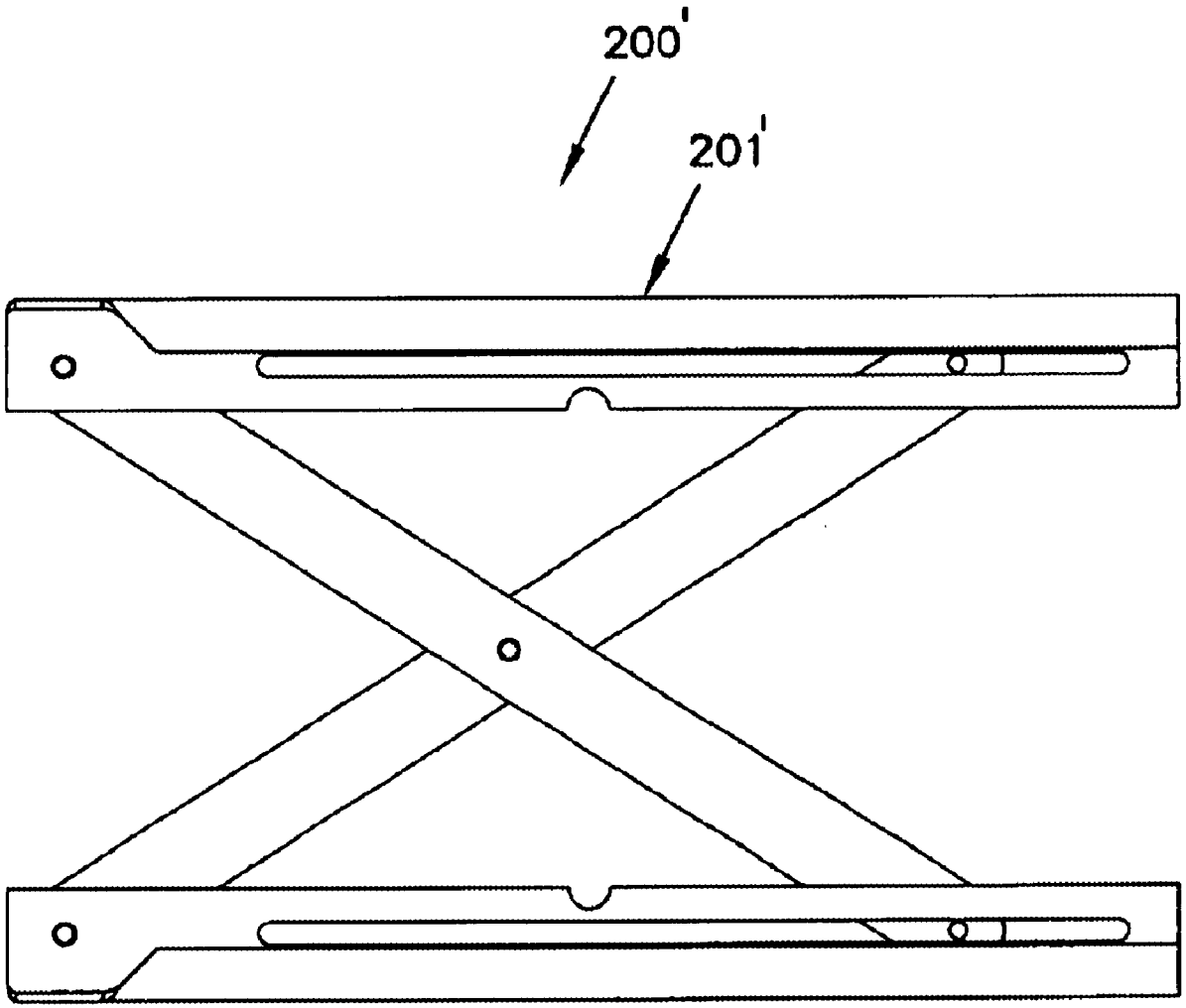
FIG. 14 is a schematic view of another example embodiment of a scissor assembly made in accordance with the present invention.

Many changes can be made to the example adjustable support structure 100 described above without departing from the spirit of the invention. For example, in FIG. 14, another example embodiment of a scissor assembly 200' is shown. The scissor assembly 200' includes only a first sub-assembly 201', rather than two subassemblies 201 and 202 as disclosed above. This sub-assembly 201' may be sized to extend across a substantially portion of the width of a front of a fireplace to support the fireplace. Alternatively, two sub-assemblies 200' may be used, positioned, for example, under opposing corners of the fireplace. Other configurations are also possible, such as, for example, three separate scissor assemblies including two angled assemblies under opposing corners of the fireplace and a straight scissor assembly under the front of the fireplace.

Figure 15:
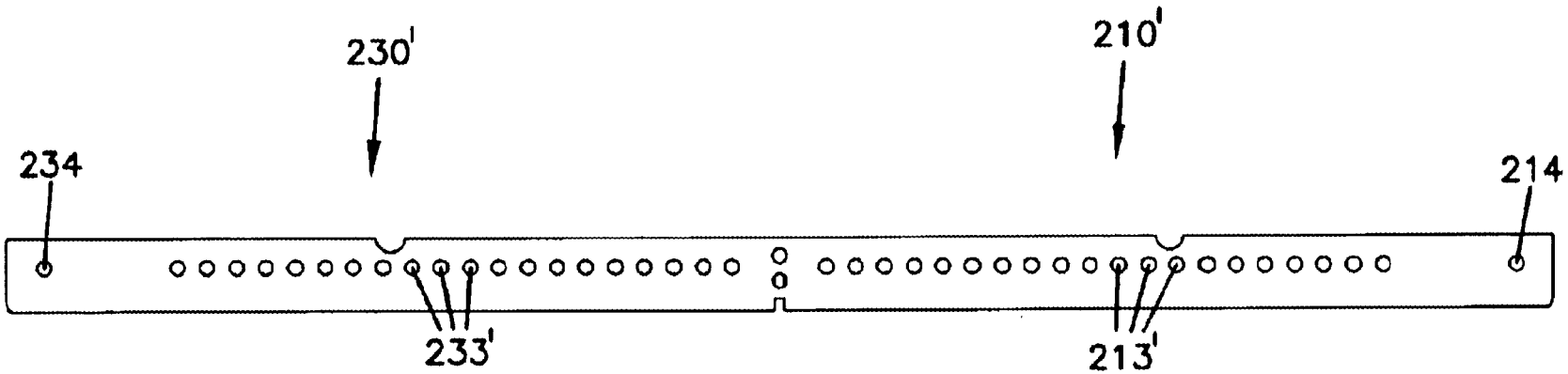
FIG. 15 is a schematic view of another example embodiment of a bar shown in isolation.

In another example of an alternative embodiment, the slots defined in the bars may be modified. Bars 210' and 230', shown in FIG. 15, each define a plurality of apertures 213' and 233' instead of a single slot. The apertures 213' and 233' function in a manner similar to the slots described above, allowing ends of the cross bars to be coupled to any of the apertures 213' and 233' to increase or decrease the height of the adjustable support structure.

In another embodiment (not shown), the slots may be formed with indentations of a greater diameter spaced along the slot. Ends of each cross bar may include an elongated pin that slides within the slot until an indentation at the desired height is reached. The pin could then be seated in the indentation, thereby locking the scissor assembly at a desired height.

In another possible alternative embodiment (not shown), each bar may be formed as two pieces that slidingly engage each other, and each cross bar may be mounted at opposite ends of each piece of the bar. To adjust the height, the two pieces of the bar may be slide to increase or decrease the overlap of the two pieces, thereby decreasing or increasing, respectively, the height of the scissor assembly. When a desired height is reached, the two pieces of each bar can be coupled to one another to lock them in place.

Other structures are also possible. For example, instead of each of the bars being formed as two pieces, each cross bar could be two pieces that slidingly engage each other. Each piece of each cross bar could be coupled at one end to the end of each respective bar, and each cross bar could extend vertically rather than crossing the opposite cross bar. The two pieces of each cross bar could be slid together or apart, thereby raising or lowering the upper bar, and affixed to one another at the desired height.

Other changes can also be made. For example, instead of using screws to couple the bars to the cross bars, other coupling devices may be used. For example, nuts and bolts, welding, or expanding gussets may be used in place of the screws to couple components of the structure support.

The configuration of the trim 800, 900, and 1000 may also be changed. For example, the front and side trims 900 and 1000 may be formed as a single, integral piece. In addition, the top trim 800 may be removed, if desired, if the fireplace 1100 covers the entire upper surface of the adjustable support structure 100. The shape of the trim may also be modified. For example, the top trim 800 can be formed in a square or rectangle shape.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed is:

1. A fireplace and an adjustable support structure for the fireplace, comprising;

upper and lower bars extending in a longitudinal direction, the upper bar being positioned above the lower bar in a plane and the upper bar defining a surface upon which the fireplace can rest; and first and second cross bars, each with upper and lower ends, the upper end of the first cross bar being coupled to the upper bar and the lower end of the second cross bar being coupled to the lower bar, and wherein the lower end of the first cross bar is moveably coupled to the lower bar and the upper end of the second cross bar is moveably coupled to the upper bar such that the upper bar may be adjusted upwards in the plane with respect to the lower bar to a desired height;

wherein at least a portion of the fireplace is supported by the upper bar of the adjustable support structure.

2. The fireplace and adjustable support structure of claim 1, wherein each of the upper and lower bars defines a slot and wherein the first cross bar is coupled to the lower bar through the slot defined in the lower bar and the upper end of the second cross bar is coupled to the upper bar through the slot defined in the upper bar.

3. The fireplace and adjustable support structure of claim 1, wherein each of the upper and lower bars defines a plurality of apertures and wherein first cross bar is coupled to the lower bar through one of the plurality of apertures defined in the lower bar and the upper end of the second cross bar is coupled to the upper bar through one of the plurality of apertures defined in the upper bar.

4. An adjustable support structure for a fireplace, the adjustable support comprising:

upper and lower bars, each extending in a longitudinal direction and each defining at least one aperture, the upper bar being positioned above the lower bar in a plane;

a scissor assembly including first and second cross bars, each with upper and lower ends and coupled to one another at about a midpoint of the first and second cross bars, the upper end of the first cross bar being coupled to a second end of the upper bar and the lower end of the second cross bar being coupled to a second end of the lower bar, and wherein the lower end of the first cross bar is moveable in the longitudinal direction towards the lower end of the second cross bar and the upper end of the second cross bar is moveable in the longitudinal direction towards the upper end of the first cross bar such that the upper bar is adjusted upwards in the plane with respect to the lower bar to a desired height and the lower end of the first cross bar may then be coupled to the at least one aperture of the lower bar and the upper end of the second cross bar may be coupled to the at least one aperture of the upper bar;

a top trim coupled to a surface of the upper bar, wherein the top trim includes a surface upon which a lower portion of the fireplace can rest; and a front trim coupled to front surfaces of the upper and lower bars.

5. The adjustable support structure of claim 4, wherein each of the at least one apertures defined in the upper and lower bars is elongated to extend in the longitudinal direction.

6. The adjustable support structure of claim 4, wherein each of the upper and lower bars defines a plurality of apertures extending along the longitudinal direction.

7. The adjustable support structure of claim 4, further comprising:

second upper and lower bars, each extending in a second longitudinal direction at an angle with respect to the longitudinal direction of the upper and lower bars, each of the second upper and lower bars defining a second slot, the second upper bar being positioned above the second lower bar in a plane and the second upper bar being coupled to the upper bar and the second lower bar being coupled to the lower bar at the angle; and a second scissor assembly coupled to the second upper and lower bars.

8. A method for adjusting a support structure for a fireplace, the method comprising steps of:

providing the support structure including upper and lower bars, a scissor assembly, and a surface for supporting the fireplace;

adjusting the adjustable support to a desired height;

coupling the scissor assembly to the bars to lock the adjustable support at the desired height; and attaching trim to the support structure to hide the upper and lower bars and the scissor assembly from view.

9. The method of claim 8, wherein the adjust step comprises a step of moving first ends of first and second cross bars of the scissor assembly towards second ends of the first and second cross bars to increase a distance between the upper and lower bars.

10. A method for supporting a fireplace, comprising steps of:

providing an adjustable support structure;

adjusting the adjustable support structure to a desired height; and upon adjustment of the adjustable support structure to the desired height, placing the adjustable support structure below the fireplace to support the fireplace.

11. A fireplace and an adjustable support structure for the fireplace, comprising:

upper and lower bars extending in a longitudinal direction, the upper bar being positioned above the lower bar and the upper bar defining a surface upon which the fireplace can rest;

first and second cross bars, each with upper and lower ends; and means for adjustably coupling the first and second cross bars to the upper and lower bars so that the adjustable support structure supports at least a portion of the fireplace at a desired height.

12. The fireplace and adjustable support structure of claim 11, wherein the upper end of the first cross bar is coupled to the upper bar and the lower end of the second cross bar is coupled to the lower bar, and wherein the lower end of the first cross bar is adjustably coupled to the lower bar and the upper end of the second cross bar is adjustably coupled to the upper bar when the adjustable support structure is at the desired height.

13. The fireplace and adjustable support structure of claim 11, wherein the first and second cross bars intersect one another at about a midpoint of each of the first and second cross bars.

* * * * *